US007731384B2

(12) United States Patent
Curran et al.

(10) Patent No.: US 7,731,384 B2
(45) Date of Patent: Jun. 8, 2010

(54) METHOD AND APPARATUS FOR PROVIDING AN LED LIGHT FOR USE IN HAZARDOUS LOCATIONS

(75) Inventors: John William Curran, Lebanon, NJ (US); John Patrick Peck, Manasquan, NJ (US); Kevin A. Hebborn, Toms River, NJ (US); William S. Leib, III, Tinton Falls, NJ (US); Anthony Verdes, Brick, NJ (US)

(73) Assignee: Dialight Corporation, Farmingdale, NJ (US)

( * ) Notice: Subject to any disclaimer, the term of this patent is extended or adjusted under 35 U.S.C. 154(b) by 424 days.

(21) Appl. No.: 11/567,710

(22) Filed: Dec. 6, 2006

(65) Prior Publication Data

US 2007/0153520 A1 Jul. 5, 2007

Related U.S. Application Data

(60) Provisional application No. 60/748,090, filed on Dec. 6, 2005.

(51) Int. Cl.
*F21V 33/00* (2006.01)

(52) U.S. Cl. ..... 362/184; 362/294; 362/267; 315/194

(58) Field of Classification Search ..... 362/184, 362/267, 545, 547, 800, 192; 315/194
See application file for complete search history.

(56) References Cited

U.S. PATENT DOCUMENTS

| | | | | |
|---|---|---|---|---|
| 5,317,305 | A | 5/1994 | Campman | |
| 6,260,508 | B1 * | 7/2001 | Morse | 116/211 |
| 6,486,797 | B1 * | 11/2002 | Laidman | 340/908.1 |
| 6,511,203 | B1 * | 1/2003 | Winther | 362/202 |
| 6,621,239 | B1 | 9/2003 | Belliveau | |
| 6,957,905 | B1 * | 10/2005 | Pritchard et al. | 362/554 |
| 6,963,175 | B2 * | 11/2005 | Archenhold et al. | 315/291 |
| 7,111,961 | B2 * | 9/2006 | Trenchard et al. | 362/235 |
| 2004/0120156 | A1 | 6/2004 | Ryan | |
| 2005/0207166 | A1 | 9/2005 | Kan et al. | |

OTHER PUBLICATIONS

PCT International Search Report and Written Opinion for PCT/US06/61700 dated Mar. 26, 2008; consists of 8 pages.

* cited by examiner

*Primary Examiner*—Ali Alavi

(57) ABSTRACT

A lighting source that can be deployed in a hazardous environment is disclosed. For example, the lighting source comprises at least one light emitting diode and a power supply for providing power to the at least one light emitting diode. The lighting source also comprises an enclosure for housing the at least one light emitting diode and the power supply, where said lighting source is for deployment in a hazardous environment.

20 Claims, 5 Drawing Sheets

METHOD AND APPARATUS FOR PROVIDING AN LED LIGHT FOR USE IN HAZARDOUS LOCATIONS

This application claims the benefit of U.S. Provisional Application No. 60/748,090 filed on Dec. 6, 2005, which is herein incorporated by reference.

The present invention relates generally to an LED light.

BACKGROUND OF THE INVENTION

There are many industrial environments where explosive atmospheres are present due to the nature of the products produced or processed. Facilities such as oil refineries, gas processing plants, mines, grain elevators, etc. are some examples of such environments where electrical discharges must be tightly controlled in order to prevent explosions.

Over the years standards have been developed to insure electrical products which minimize the potential for electrical discharges such as sparks or arcs. Through a design process of careful component selection, proper pc board trace spacing, appropriate dielectric insulation, etc. products can be produced which can be safely used in these hazardous environments.

In order to develop safety requirements for these various hazardous environments a series of classifications have been developed to categorize them. For example Class 1 hazardous environments include those containing flammable gases, vapors or liquids; Class 2 includes combustible dusts; Class 3 includes ignitable fibers. Environments where those explosive atmospheres are abnormally present are further classified as Division 2 environments, whereas those explosive atmospheres are normally present are classified as Division 1 environments. Therefore, an environment which consisted of flammable gases which were sometimes present would be considered a Class 1 Division 2 area.

As with any type of environment, lighting is an important element. Lighting serves multiple purposes with two applications in particular of interest in this application: signaling and general illumination. Signaling is the use of lighting to indicate some state or presence. Obstruction lighting used to indicate the presence of towers and buildings to aircraft is one example (e.g. beacons used on the tops of radio transmission towers). General illumination lighting is that lighting used to make objects and spaces visible in dark environments (e.g. walkway lights used to illuminate gantries and ladders in refineries). And for those locations where explosive atmospheres could be present, a lighting fixture which is resistant to exposing electrical discharges would be advantageous. Present designs for these devices typically use traditional light sources such as incandescent, fluorescent, or gas discharge lamps. Such sources while providing good photometric properties have a major disadvantage of limited lifetime. The average lifetimes typically range from 1 k to 20 k hours for traditional light sources. Furthermore, such sources are often quite expensive when they are manufactured to meet safety requirements for various hazardous environments.

Therefore, there is a need for a light source that is capable of providing a longer lifetime while operable in a hazardous location.

SUMMARY OF THE INVENTION

In one embodiment, the present invention provides a lighting source that can be deployed in a hazardous environment. For example, the lighting source comprises at least one light emitting diode and a power supply for providing power to the at least one light emitting diode. The lighting source also comprises an enclosure for housing the at least one light emitting diode and the power supply, where said lighting source is for deployment in a hazardous environment.

BRIEF DESCRIPTION OF THE DRAWINGS

The teaching of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
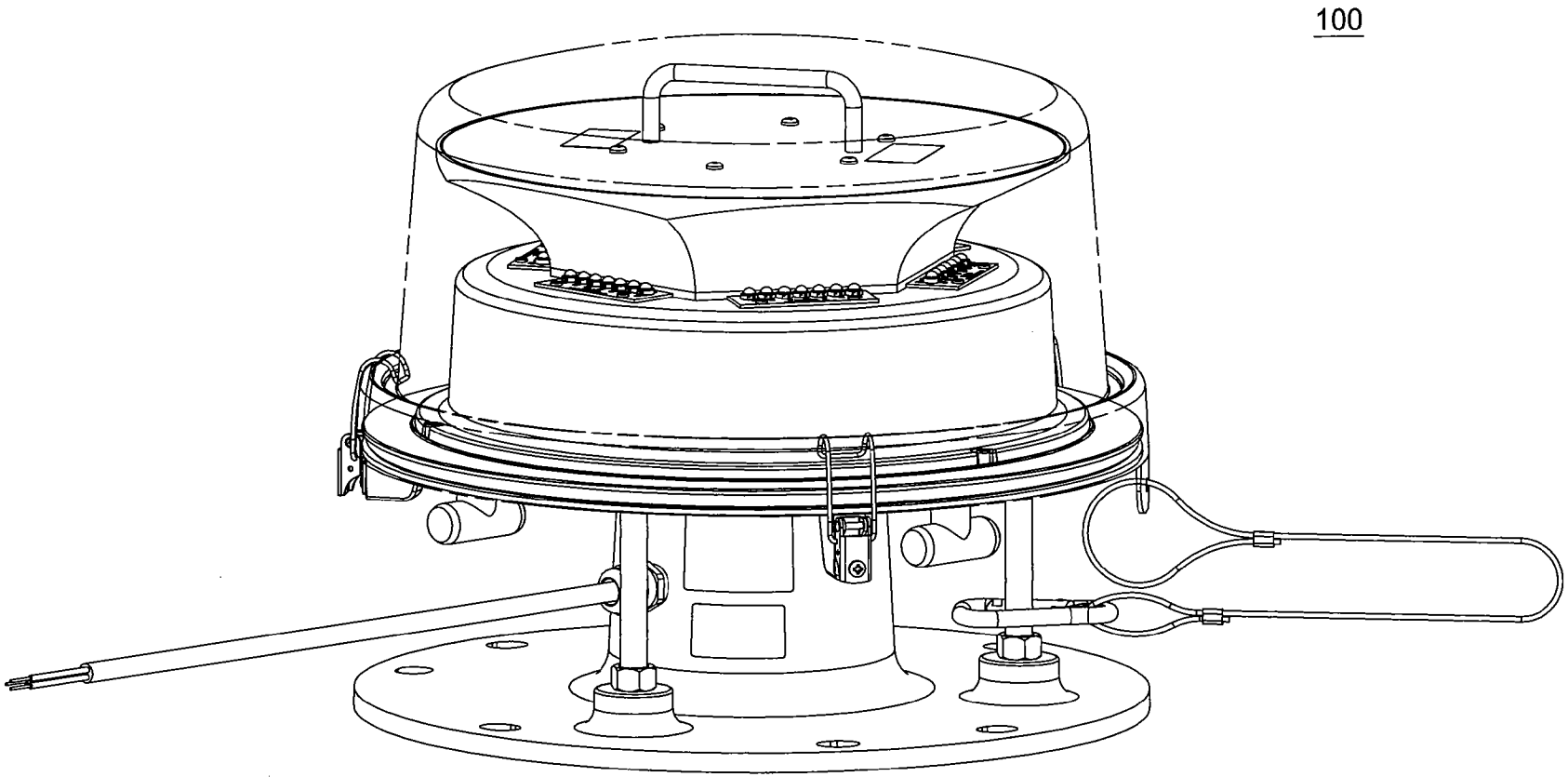
FIG. 1 illustrates an LED beacon warning light related to the present invention.

FIG. 1 illustrates an LED beacon warning light 100 (broadly a lighting source) related to the present invention. Such lights are used to signal obstructions to aviation such as radio towers, flare stacks, etc. More specifically, the LED beacon warning light 100 of the present invention is capable of being deployed in a hazardous environment. In one embodiment, a hazardous environment encompasses an environment that is hazardous due to the presence of flammable/combustible gases (e.g., acetylene, ethylene, propane and hydrogen), due to the presence of flammable/combustible dusts including conductive metal, carbonaceous dust and grain dust, and/or due to the presence of flammable/combustible fibers or flyings.

One unique difference of the LED beacon warning light 100 of the present invention when compared to a traditional beacon is that the typical traditional light source is replaced by one or more light emitting diodes (LEDs). In one embodiment, the LED beacon warning light 100 employs a plurality of arrays of LEDs.

Replacing the typical traditional light source with high brightness LED (light emitting diode) sources provides a number of advantages over conventional approaches. One advantage is the size of the source. Since LEDs are very small, a large number of them can be packaged in a lighting enclosure to provide a wide range of light intensities. The size of LED sources allows the use of optics to precisely position the light output. This is not typically possible with more traditional sources. Simple reflectors can be designed to direct the light output to the exact location desired required by the beacon to be used in the hazardous environment.

Another advantage of the LED approach is the long lifetimes inherent in the operation of an LED light source. LEDs have typical lifetimes of 50-100 k hours or more. Compared to more conventional sources, a warning beacon comprising LEDs for the light source could last 20 times longer. Since these warning beacons are often located in inaccessible locations, the longer lifetime provides a major advantage in reducing the cost of replacement in terms or parts and labor. Changing the lamp in hazardous locations requires opening the fixture and often requires turning off power to the affected area. This can shut down production and require additional personnel.

A third advantage of using LEDs in a hazardous location warning beacon involves the operating voltage required by the LEDs. In many cases, LEDs can be operated at lower voltages than more conventional lighting systems. Using a lower voltage can also provide a lighting fixture which is inherently less prone to electrical discharge.

FIG. 1 illustrates an exemplary embodiment of an LED signaling beacon suitable for meeting a Class 1 Division 2 classification. In one embodiment, the LED beacon may employ a number of levels or stacks of LED/reflector assemblies that could be coupled together based on the desired amount of light required. In FIG. 1, only one level of LED/reflector assembly is shown. Furthermore, the shape of the reflectors used can be varied to produce light in different patterns based on the desired lighting requirements.

Figure 2:
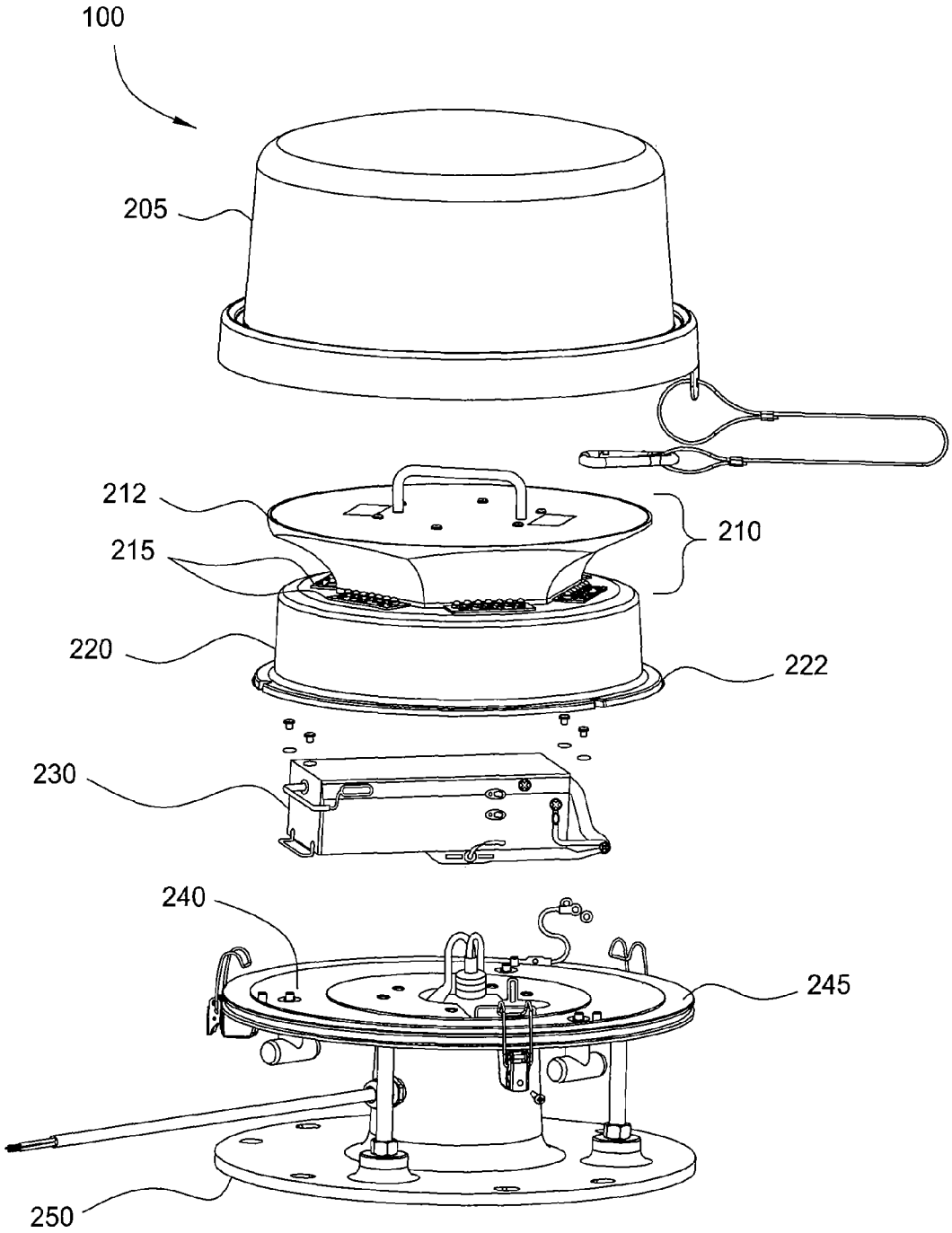
FIG. 2 illustrates an exploded view of the LED beacon warning light of FIG. 1.

FIG. 2 illustrates an exploded view of the LED beacon warning light 100 of FIG. 1. In one embodiment, the LED beacon warning light 100 comprises a transparent cover 205, an LED/reflector assembly 210, a metal cover plate 220, a power supply assembly 230, a base plate 240, a gasket 245, and a base 250. The LED/reflector assembly 210 comprises one or more LED arrays 215 and a reflector 212. In one embodiment, LED beacon warning light 100 of FIG. 1 is deployed in a hazardous environment.

In operation, the base 250 is mounted to a structure, e.g., a tower, an antenna, a pole, a building, and the like. In one embodiment, the structure is deployed in the hazardous environment. The base 250 serves the function of mounting the LED beacon warning light to the structure.

The metal base plate 240 is coupled to the base 250. The metal base plate 240 serves as a bottom enclosure for receiving the transparent cover 205. In one embodiment, a gasket 245 (e.g., an O-ring) is disposed on the metal mounting plate 240 such that when the transparent cover 205 is mounted to the metal base plate 240, a tight seal is formed to minimize the ability of explosive gases and/or particles from entering into the LED beacon warning light 100.

The metal base plate 240 also serves as a platform for mounting the power supply assembly 230. In one embodiment, the bottom of the power supply assembly 230 is in direct contact with the metal base plate 240. This direct contact allows heat that is generated by the power supply assembly 230 to be dissipated through the metal base plate 240. Since the metal base plate 240 is coupled to the metal base 250, the heat generated by the power supply assembly is safely removed from the LED beacon warning light 100 via the base 150. Lowering the temperature of the LED beacon warning light 100 is an advantageous feature when the LED beacon warning light 100 is deployed in a hazardous environment. The lower temperature reduces the ability of the LED beacon warning light 100 to ignite an explosive gas or combustible particles.

In one embodiment, the power supply assembly 230 is also potted or encapsulated with a thermally conductive material (not shown), e.g., a silicon-based rubber. The thermally conductive material reduces the risk of ignition by limiting the enclosed volume in the power supply into which the explosive atmosphere can collect as well as by providing a better heat path, thereby reducing the heat of the power supply assembly 230. Namely, the thermally conductive material assists in quickly dissipating the heat of the power supply.

In one embodiment, the metal cover plate 220 is disposed over the power supply and onto the base plate 240. It should be noted that the insulating material keeps the power supply assembly 230 from making direct contact with the metal cover plate 220. The metal cover plate 220 serves as a platform for mounting the LED/reflector assembly 210. It should be noted that the LED arrays 215 will generate heat during the operation of the beacon. However, since the LED arrays are mounted directly over the metal cover plate 220, the heat generated by the LED arrays are dissipated through the metal cover plate 220. Again, since the metal cover plate 220 is coupled to the metal base plate 240 which, in turn, is coupled to the metal base 250, the heat generated by the LED arrays are also safely removed from the LED beacon warning light 100.

In one embodiment, the metal cover plate 220 contains a lip 222. The lip 222 is designed to increase the total surface area of the metal cover plate 220 that is making contact with the metal base plate 240. This allows a greater transfer of heat from the metal cover plate 220 to the metal base plate 240. In one embodiment the heat is transferred upward to a heatsink located on the top of the light. FIG. 1 illustrates an embodiment where the heat is generally transferred from the LEDs downward. The mechanical assembly provides a good thermal path to the base plate 240 and base 250. The base plate 240 and base 250 act as a heatsink to remove the heat through convection. The base plate 240 can have a finned or non-smooth surface to increase the surface area and heat dissipation. A clear dome 205 covers and seals the light. In one embodiment the LEDs are mounted in a vertical configuration with respect to the light fixture. FIG. 1 illustrates an embodiment where the LEDs are mounted horizontally surface. This configuration reduces the volume taken by the light fixture and therefore minimizes the amount of potentially explosive gases that could collect within the light.

Figure 3:
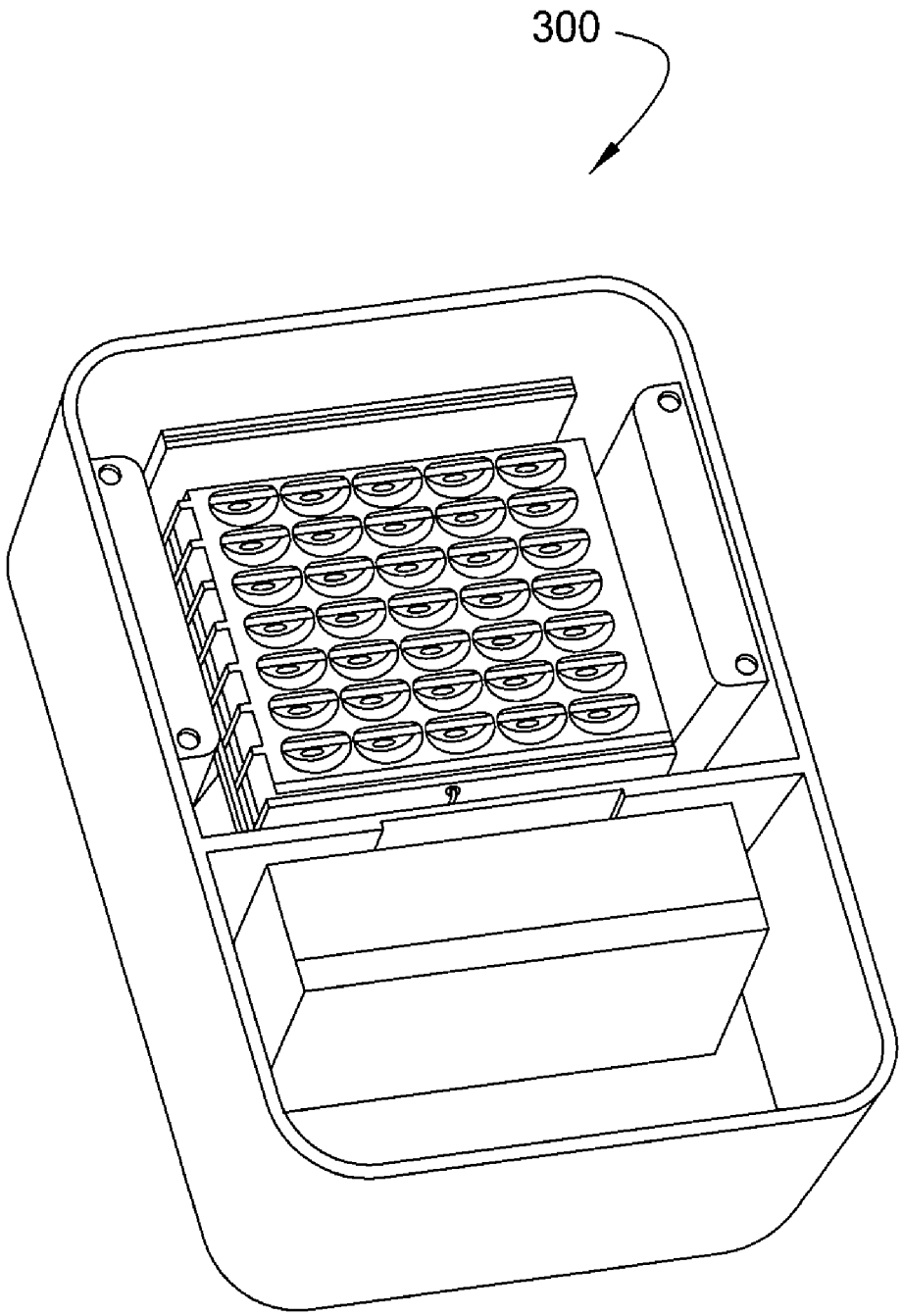
FIG. 3 illustrates an LED Light Source for use in an area light related to the present invention.

FIG. 3 illustrates an exemplary embodiment of an LED lighting fixture (broadly a lighting source, e.g., an LED area lighting module) 300 fitted in an enclosure which would meet a Class 1 Division 2 classification. Again, the number of LED/reflector banks could be adjusted based on the desired amount of light required. Although FIG. 3 illustrates 5 LEDs in each row, the present invention is not so limited. Namely, each row may employ of one or more LEDs as required for a particular application. Similarly, the shape of the reflectors used can be varied to produce light in different patterns based on the desired lighting requirements.

Figure 4:
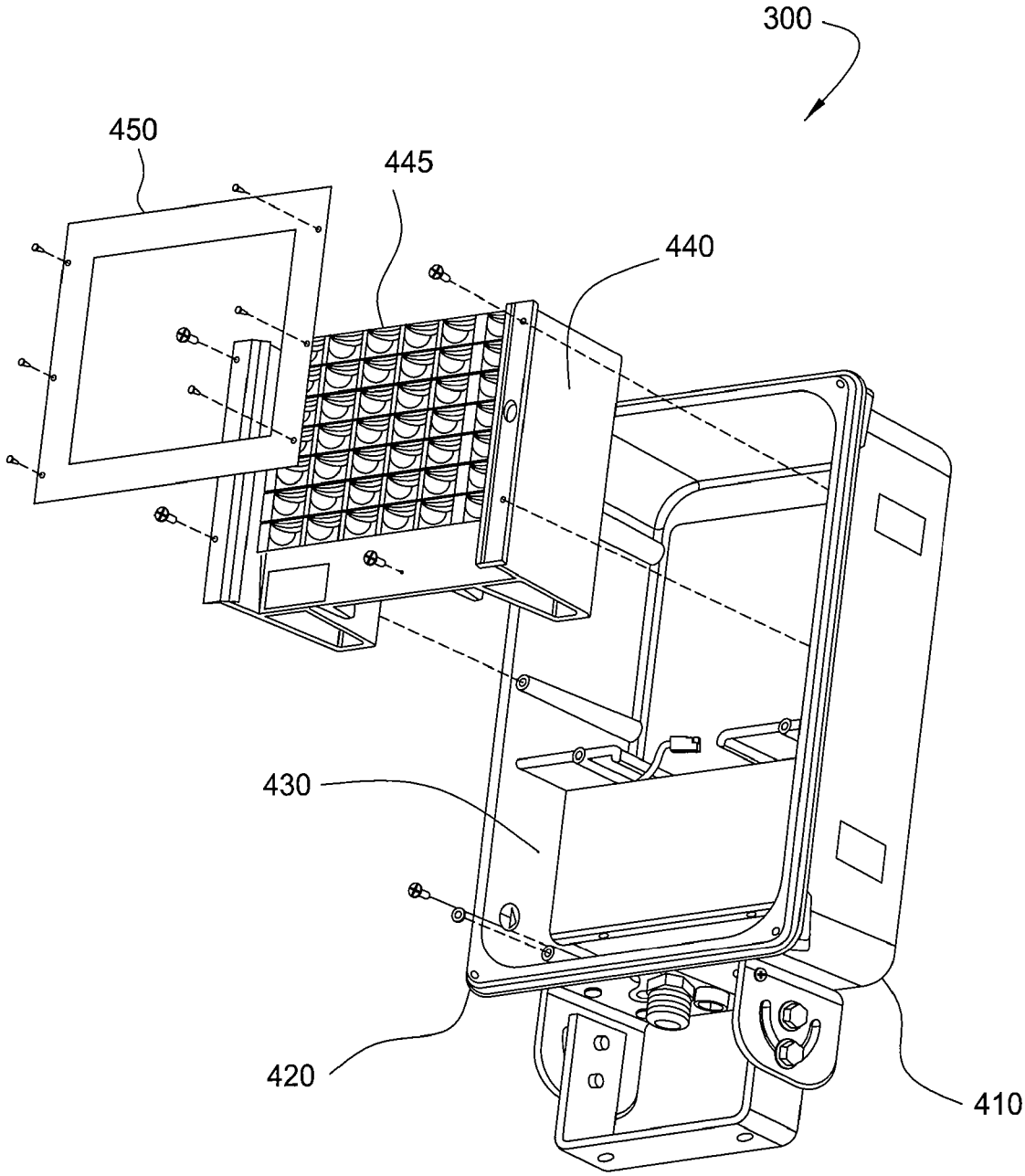
FIG. 4 illustrates an exploded view of the LED Light Source of FIG. 3.

FIG. 4 illustrates an exploded view of the LED lighting fixture 300 of FIG. 3. In one embodiment, the LED lighting fixture 300 comprises a transparent cover 450, an LED/reflector assembly 445, a metal plate or heatsink 440, a power supply assembly 430, a gasket 420, and a metal base 410. In one embodiment, LED lighting fixture 300 of FIG. 4 is deployed in a hazardous environment.

In operation, the metal base 410 is mounted to a structure, e.g., a tower, an antenna, a pole, a building, and the like. In one embodiment, the structure is deployed in the hazardous environment. The base 410 serves the function of mounting the LED lighting fixture 300 to the structure.

The metal plate or heatsink 440 is coupled to the base 410. The metal plate 440 serves as a platform for mounting the LED/reflector assembly 445. It should be noted that the LED arrays on the LED/reflector assembly 445 will generate heat during the operation of the lighting fixture. However, since the LED arrays are mounted directly to the metal plate 440, the heat generated by the LED arrays are dissipated through the metal plate 440. Again, since the metal plate 440 is coupled to the metal base 410, the heat generated by the LED arrays are safely removed from the LED lighting fixture 300.

The metal base 410 also serves as a platform for mounting the power supply assembly 430. In one embodiment, the bottom of the power supply assembly 430 is in direct contact with the metal base 410. This direct contact allows heat that is generated by the power supply assembly 430 to be dissipated through the metal base 410. Thus, the heat generated by the power supply assembly is safely removed from the LED lighting fixture 300 via the base 410. Again, lowering the temperature of the LED lighting fixture 300 is an advantageous feature when the LED lighting fixture 300 is deployed in a hazardous environment. The lower temperature reduces the ability of the LED lighting fixture 300 to ignite an explosive gas or combustible particles.

In one embodiment, the power supply assembly 430 is also potted or encapsulated with a thermally conductive material (not shown), e.g., a silicon-based rubber. The conductive material reduces the risk of ignition by limiting the enclosed volume in the power supply into which the explosive atmosphere can collect as well as by providing a better heat path, thereby reducing the heat of the power supply assembly 430. Namely, the conductive material assists in quickly dissipating the heat of the power supply.

In one embodiment, a gasket 420 is disposed on the metal base 410 such that when the transparent cover 450 (partially shown) is mounted to the metal base 410, a tight seal is formed to minimize the ability of explosive gases and/or particles from entering into the LED lighting fixture 300.

The power supply required to drive the LEDs used in this Class 1 Division 2 application is also required to meet certain specifications designed to minimize the potential for electrical discharge. Since LEDs typically require a constant current source, the power supply must be able to provide this current while at the same time meeting the electrical requirements for a Class 1 Division 2 power supply.

In one embodiment, the present invention discloses a current regulated power supply. For example, a current regulated power supply delivers a targeted current to the LEDs regardless of input variations such as voltage and temperature. More specifically, the current is regulated by a closed-loop control circuit.

Figure 5:
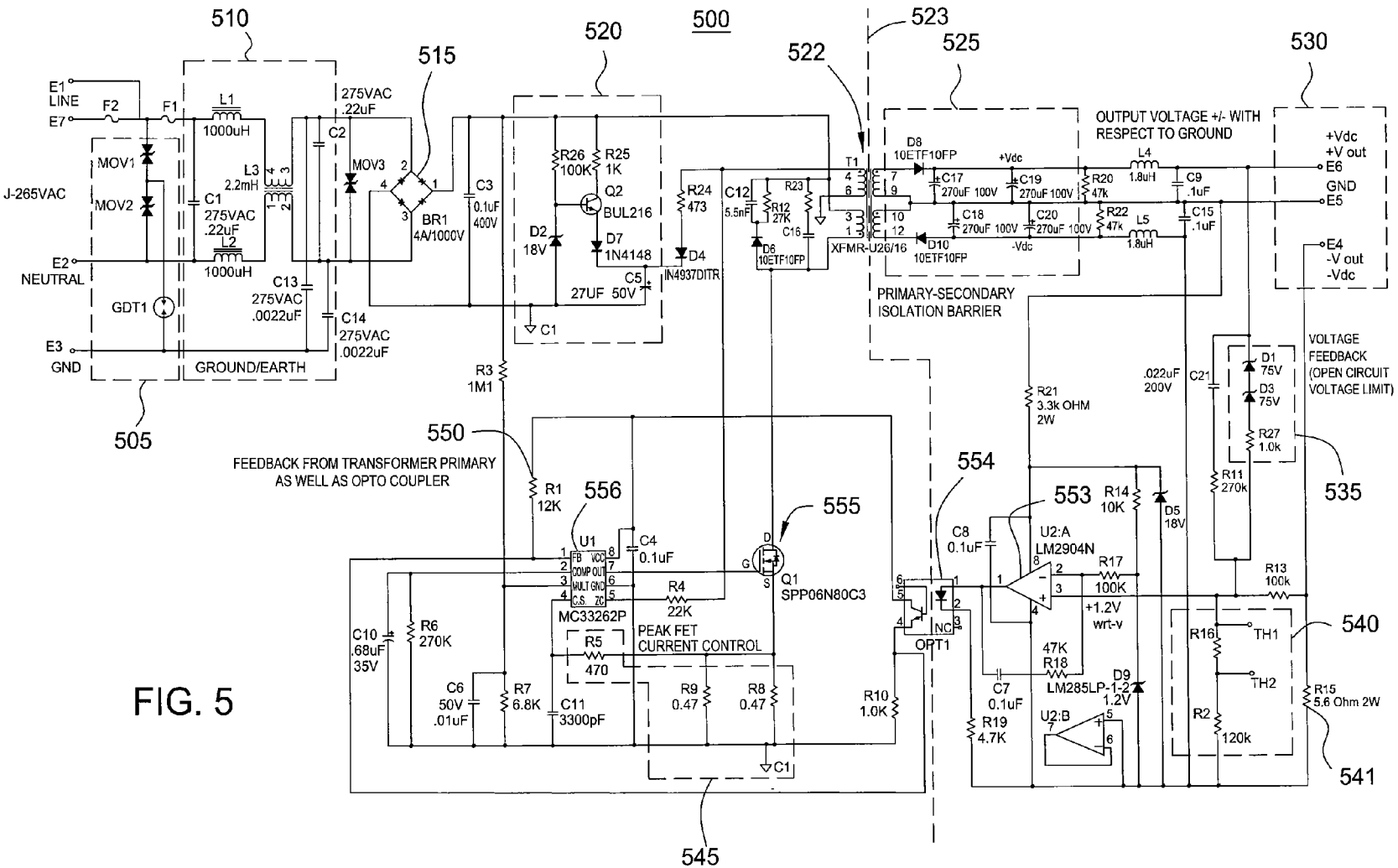
FIG. 5 illustrates an example of a Circuit Schematic.

FIG. 5 is a schematic of a power supply 500 which can provide the required constant current for the LEDs used in the Class 1 Division 2 application. In one embodiment, the output current of the power supply is made to increase with either ambient or LED temperature. This provides at least two benefits. As temperatures increase, LEDs will typically provide less light output. This circuit would compensate for that light loss by driving the LEDs at a higher current. Second, this approach would increase LED life by allowing them to run at a lower current at lower ambient temperatures where their light output is adequate. This would increase the life expectancy of the LEDs. The temperature compensation is achieved by means of a thermistor, connected to the feedback circuit of the power supply. Parallel and series resistors allow the desired temperature/LED current profile to be shaped.

A brief description is now provided for the power supply 500. More specifically, aspects of the power supply 500 that provide advantages in the operation of the light source in a hazardous environment will be described.

In one embodiment, the mains supply is connected to E1-E3. Surge protection 505 is provided by MOV1, MOV2 and GDT1. An EMI filter 510 (e.g., C1, C2, L1-L3, C13 and C14) provides noise filtering and BR1 515 rectifies the incoming supply to create full wave rectified dc.

In one embodiment, a startup circuit 520 is provided. More specifically, Q2 and associated components provides a dc supply to start up the switch mode control IC, U1 556. Once the supply has started, the base emitter of Q2 becomes reverse biased and switches off (so as not to waste power in Q2), since U1 then receives its power from the auxiliary winding between pins 4 and 6 of T1.

In one embodiment, the output 530 of the power supply is split. Namely, the output voltage is split +/− with respect to ground E5 and output terminals E4 and E6, i.e., to halve the voltage with respect to ground (had one side been grounded), thereby reducing risk of arcing. This lowering of the output voltage will significantly reduce the risk of arcing.

More specifically, output rectifiers and smoothing module 525 comprises D8, D10 and smoothing capacitors C17-C20 for providing a dc supply for the LEDs. The center of the secondary of transformer T1 is connected to ground so that the supply to the LEDs is split, plus and minus with respect to ground. This reduces the maximum voltage with respect to ground.

In one embodiment, if the load, e.g., the LED chain or array, becomes an open circuit, then the open circuit voltage is limited by means of feedback via an over voltage sense circuit 535 (D1, D3, R27) from the isolated side (right of dashed line 523) of the power supply. Namely, if an open circuit condition exists, D1 and D3 start to conduct, thereby providing a feedback path that will limit the output voltage. In other words, should the LEDs become open circuit, the output voltage will rise until zener diodes D1 and D3 begin to turn on, thereby providing voltage feedback to 553 (U2:A) for limiting the output voltage. This allows the power supply to operate safely into an open circuit. Thus greatly reducing the risk of power supply failure in such a way that might create an arc or spark in the event of an open circuit load or from a spark due to excessive output voltage In one embodiment, if the optically isolated feedback path fails, then the output power and voltage is still limited by means of feedback via R1 550 from the non-isolated side (left of dashed line 523) of the power supply. In other words, U1 556 will still receive a feedback signal on pin 1. Normally this is determined by the output from OPT1. However, in the event of a feedback failure from the isolated side (right of dashed line 523), output power will still be limited by the effect of R1 and a rise in voltage from the auxiliary winding on T1 522 (pins 4 and 6). This design will reduce the risk of arcing in the event of a power supply fault in the form of the optically isolated feedback failing.

In one embodiment, the output current is also limited by a peak FET current control circuit, e.g., a set of FET peak current sense resistors (R8, R9, and R5). Namely, the circuit looks at the peak current at the switching FET 555, i.e., the FET is shut down if a peak current is detected. For example, output current is limited, both by means of opto coupled feedback (OPT1) 554 and the peak FET current control. Hence the overall output power is limited, thereby reducing the risk of overheating a component in the event of a power supply fault.

More specifically, U1 556 is a power factor correction control IC, that drives Q1 555. The power supply uses a transition mode flyback topology. U1 controls the peak current in FET Q1 on a pulse by pulse basis. The FET current is sensed across R8 and R9 and the sense voltage fed into pin 4. In the event of feedback loss, U1 will automatically limit the FET current to a maximum level determined by the values of R8 and R9, thereby limiting the power output.

In one embodiment, a high degree of primary-secondary isolation is provided due to the plug and chamber construction of transformer (T1) 522, as well as opto coupled feedback (OPT1) 555. Hence, lower load-side voltages will again reduce risk of arcing.

In one embodiment, resistors and other key components of the power supply have flame proof coatings.

In one embodiment, generous creepage and clearance distances are provided on the power supply, to minimizing the risk of arcing. The lower operating voltage of the LEDs allows the spacing between the traces on the circuit board can be smaller, thereby leading to a smaller circuit board implementation and potentially lower cost.

In one embodiment, the current feedback can be modified by a thermistor across R16 and R2 540 to provide temperature compensation, whereby the LED current can be automatically increased at higher temperatures.

In one embodiment, the LED current is sensed by U2:A 553 across R15 541. This voltage is compared to the reference set up on pin 2 of U2:A and a control voltage generated on the output of U2:A, which drives OPT1 so as to control the LED current.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A lighting source, comprising:

at least one light emitting diode;

a current regulated power supply that delivers a targeted current to the at least one light emitting diode comprising a closed-loop control circuit for providing power to said at least one light emitting diode; and an enclosure for housing said at least one light emitting diode and said power supply, where said lighting source is for deployment in a hazardous environment.

2. The lighting source of claim 1, wherein said lighting source is a beacon.

3. The lighting source of claim 1, wherein said lighting source is a general illumination lighting module.

4. The lighting source of claim 1, wherein said enclosure comprises a metal base.

5. The lighting source of claim 4, further comprising:

a metal cover plate, wherein said at feast one light emitting diode is mounted onto said metal cover plate.

6. The lighting source of claim 5, further comprising:

a metal base plate, wherein said metal cover plate is coupled to said metal base plate.

7. The lighting source of claim 6, wherein said metal base plate is coupled to said metal base.

8. The lighting source of claim 7, wherein heat generated by said at least one light emitting diode is dissipated via said metal base.

9. The lighting source of claim 6, wherein said current regulated power supply is mounted to said metal base plate.

10. The lighting source of claim 9, wherein said current regulated power supply is encapsulated with a thermally conductive material.

11. The lighting source of claim 4, further comprising:

a metal plate, wherein said at least one light emitting diode is mounted onto said metal plate.

12. The lighting source of claim 11, wherein said metal plate is coupled to said metal base.

13. The lighting source of claim 12, wherein heat generated by said at least one light emitting diode is dissipated via said metal base.

14. The lighting source of claim 4, wherein said current regulated power supply is mounted directly to said metal base.

15. The lighting source of claim 14, wherein said current regulated power supply is encapsulated with a thermally conductive material.

16. The lighting source of claim 1, further comprising:

a gasket; and a cover for engaging said gasket for forming a tight seal.

17. The lighting source of claim 1, wherein an output voltage of said current regulated power supply is split.

18. The lighting source of claim 1, wherein said current regulated power supply employs a thermistor for providing temperature compensation.

19. The lighting source of claim 1, wherein said current regulated power supply limits an output voltage when an open circuit condition is detected.

20. The lighting source of claim 1, wherein said current regulated power supply limits an output current.

* * * * *